US005876231A

United States Patent [19]

Pacher

[11] Patent Number: 5,876,231

[45] **Date of Patent: *Mar. 2, 1999**

[54] CONNECTOR FOR AIRBAG SYSTEM

[75] Inventor: Franz Pacher, Obervellach, Austria

[73] Assignee: Framatome Connectors USA, Norwalk, Conn.

[ * ] Notice: This patent issued on a continued prosecution application filed under 37 CFR 1.53(d), and is subject to the twenty year patent term provisions of 35 U.S.C. 154(a)(2).

[21] Appl. No.: 709,817

[22] Filed: Sep. 10, 1996

[51] Int. Cl.[6] ..... H01R 13/627

[52] U.S. Cl. ..... 439/354

[58] Field of Search ..... 439/350, 357, 439/358, 282, 353, 354, 680, 695, 696, 694, 689, 465, 731, 906, 681, 352

[56] References Cited

U.S. PATENT DOCUMENTS

| | | | |
|---|---|---|---|
| 3,141,718 | 7/1962 | Schott et al. . | |
| 3,810,075 | 5/1974 | Turner | 439/465 |
| 4,168,877 | 9/1979 | Little et al. . | |
| 4,824,402 | 4/1989 | Sorimachi | 439/680 |
| 4,915,648 | 4/1990 | Takase et al. . | |
| 5,158,473 | 10/1992 | Takahashi et al. . | |
| 5,173,063 | 12/1992 | Barkus et al. | 439/681 |
| 5,288,242 | 2/1994 | Muzslay . | |
| 5,362,261 | 11/1994 | Puerner . | |
| 5,435,742 | 7/1995 | Cecil, Jr. . | |
| 5,609,498 | 3/1997 | Muzslay | 439/352 |

FOREIGN PATENT DOCUMENTS

| | | |
|---|---|---|
| 0 537 751 A1 | 4/1993 | European Pat. Off. . |
| 0 591 947 A2 | 4/1994 | European Pat. Off. . |

*Primary Examiner*—Neil Abrams
*Assistant Examiner*—Brian J. Biggi
*Attorney, Agent, or Firm*—Pollock, Vande Sande & Amernick

[57] ABSTRACT

An electrical assembly includes a socket member and a plug member adapted for mating with the socket member along a mating axis of the socket member. The socket member has a mating aperture having a side wall portion and a bottom wall portion. The side wall portion has a locking slot, while the bottom wall portion has at least one pin contact and at least one tab member. Each pin contact and each tab member extends from the bottom wall portion substantially parallel to the mating axis. The plug member includes a bottom surface and a resilient locking device adapted for engaging in the locking slot of the side wall portion of the socket member. The bottom surface has a socket contact aperture corresponding to each pin contact extending from the bottom wall portion of the mating aperture and a tab aperture corresponding to each tab member extending from the bottom wall portion of the mating aperture. The resilient locking device includes at least two arms which, upon application of a force to effect separation of the plug member from the socket member, spread apart for locking the plug member in the socket member and for preventing separation of the plug member from the socket member.

8 Claims, 7 Drawing Sheets

CONNECTOR FOR AIRBAG SYSTEM

BACKGROUND OF THE INVENTION

1. Field of Invention

The present invention relates to electrical connectors for use with vehicle occupant inflatable restraint systems, generally known as airbag systems. More particularly, the present invention relates to a connector plug having an engagement device for engaging with a connector socket of an airbag system.

2. Description of the Related Art

Use of airbag systems in motor vehicles has become virtually universal in recent years and is mandatory in many jurisdictions. Such systems normally include an airbag assembly mounted in a hidden compartment beneath the dashboard and an electrical or electronic control system for activating the assembly upon occurrence of a crash. The airbag assembly is generally connected to the control system by a wiring harness provided with a plug with socket contacts and a socket that receives pin contacts of the initiater.

A connector system of this type is shown, for example, in EP 0 591 947, in which the system is associated with an interlock including a locking element that is inserted into the connection to prevent separation of a pair of male connector elements carried by a first component from a pair of female connector elements carried by a second component and releasably mated therewith. A shorting element is associated with the first component and includes a pair of contact elements each biased into electrical contact with one of the pair of first connector elements for producing a short therebetween. The second component has a body comprising a portion contoured to enter between the pairs of connector elements for disconnecting the short upon mating of the first and second components, which are mechanically latched together. The locking element prevents release of the latch and hence separation of the two components while in the locked position.

In EP 0 537 751, which relates to a switch connector assembly having a structure that prevents admission of water, the female connector has a short-circuiting terminal extending into a connector fitting chamber of the female connector, as well as a temporary arresting projection and a flexible locking arm with a final arresting projection. The male connector has a connecting terminal, a flexible engaging pawl, and an engaging portion. When the temporary arresting projection is fitted with the pawl, the short-circuiting terminal is kept out of contact with the connecting terminal, but the two terminals enter into contact when the final arresting projection is fitted with the engaging portion.

SUMMARY OF THE INVENTION

The present invention provides an electrical connector assembly that includes a socket member and a plug member adapted for mating with the socket member along a mating axis of the socket member. The socket member has a mating aperture that has a side wall portion and a bottom wall portion. The side wall portion has a locking slot, while the bottom wall portion has at least one pin contact and at least one tab member. Each pin contact and each tab member extend from the bottom wall portion substantially parallel to the mating axis. The plug member includes a bottom surface and a resilient locking device adapted for engaging in the locking slot of the side wall portion of the socket member. The bottom surface has a socket contact aperture corresponding to each pin contact extending from the bottom wall portion of the mating aperture and a tab aperture corresponding to each tab member extending from the bottom wall portion of the mating aperture. The resilient locking device includes at least one arm which, upon application of a force to effect separation of the plug member from the socket member, spreads so as to lock the plug member in the socket member and to prevent separation of the plug member from the socket member.

Preferably, each tab member is separated from the side wall portion of the mating aperture, and each arm of the resilient locking device extends from the bottom surface of the plug member and engages the locking slot of the side wall portion of the socket member. The locking slot includes a shoulder portion extending substantially perpendicular to the mating axis. Each arm includes a detent member having a divergent portion and an abutment portion. The abutment portion extends substantially perpendicular to the mating axis and abuts the shoulder portion of the locking slot, preventing separation of the plug member from the socket member upon spreading of the arms when the force is applied.

The plug member includes a socket contact disposed within each socket contact aperture. Each socket contact has a first end for receiving the corresponding pin contact on the airbag initiator side, and a second end for receiving a wire from, for example, the airbag system side. For structural integrity, the plug member includes a cover having laterally located locking lugs, and a socket housing portion having locking lug receiving members engaging the locking lugs of the cover when the cover and socket housing are mated. The cover includes a nipple extending toward the socket housing when the cover and socket housing are mated so that the wire is clasped between the nipple and the socket housing portion. The wire grippers are exchangable according to the wire diameter.

BRIEF DESCRIPTION OF THE DRAWINGS

The present invention is illustrated by way of example and not limitation in the accompanying figures in which like reference numerals indicate similar elements and in which.

DETAILED DESCRIPTION OF THE PREFERRED EMBODIMENT

Figure 1:
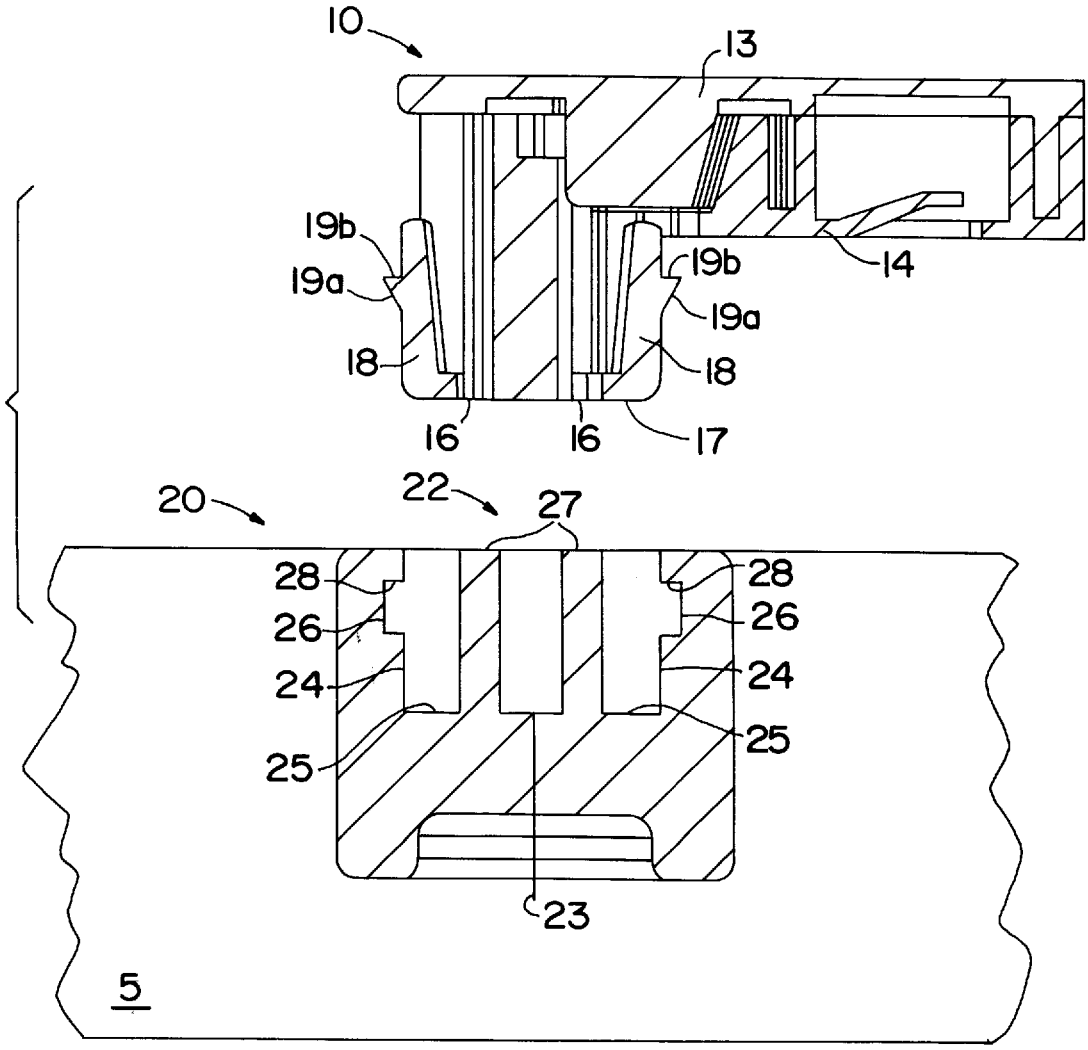
FIG. 1 is a cross-sectional view of an unmated plug part and an initiator socket part of a connector according to the present invention.
Figure 2:
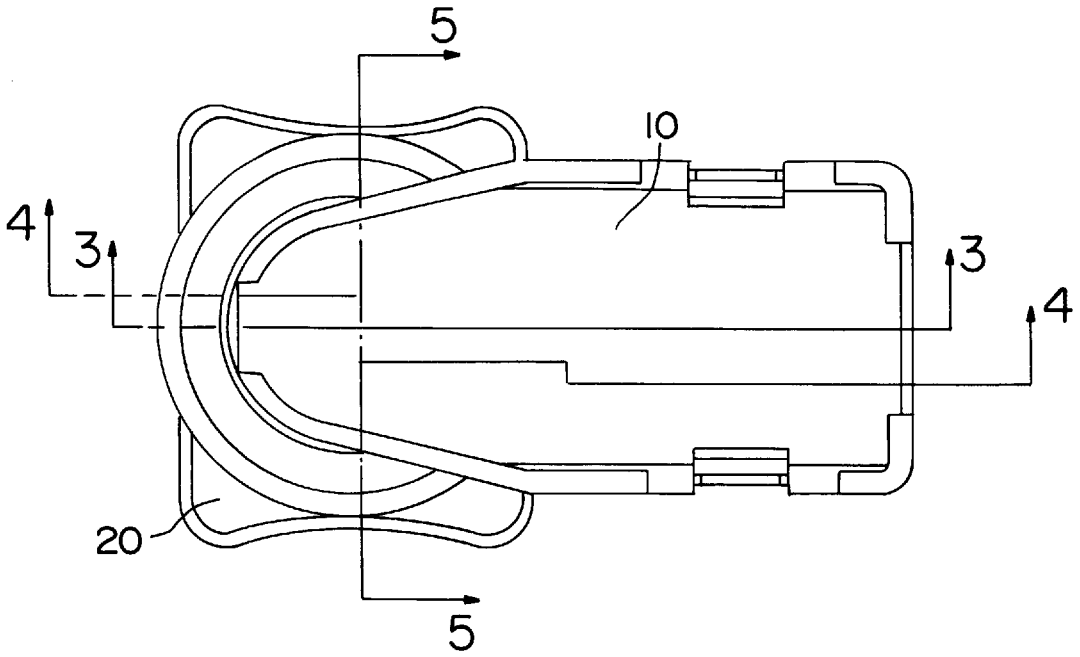
FIG. 2 is a top view of a mated plug part and an initiator socket part of a connector according to the present invention.
Figure 3:
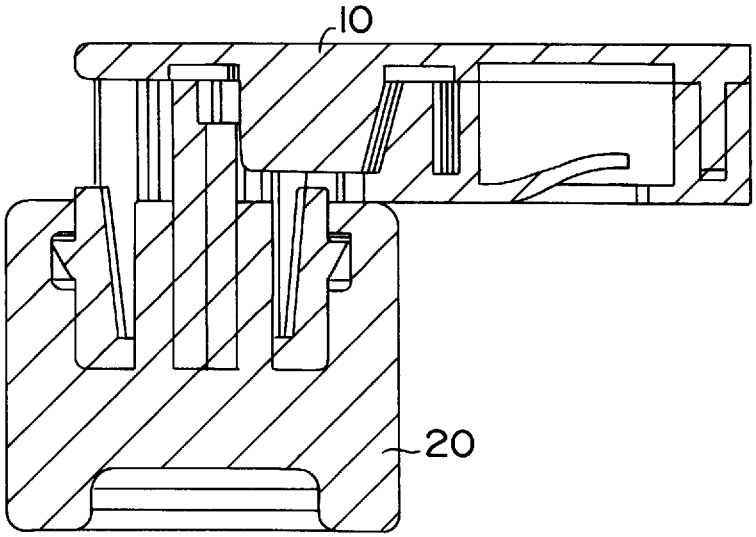
FIG. 3 is a cross-sectional view of a mated plug part and an initiator socket part of a connector according to the present invention, taken along line 3—3 in FIG. 2.
Figure 4:
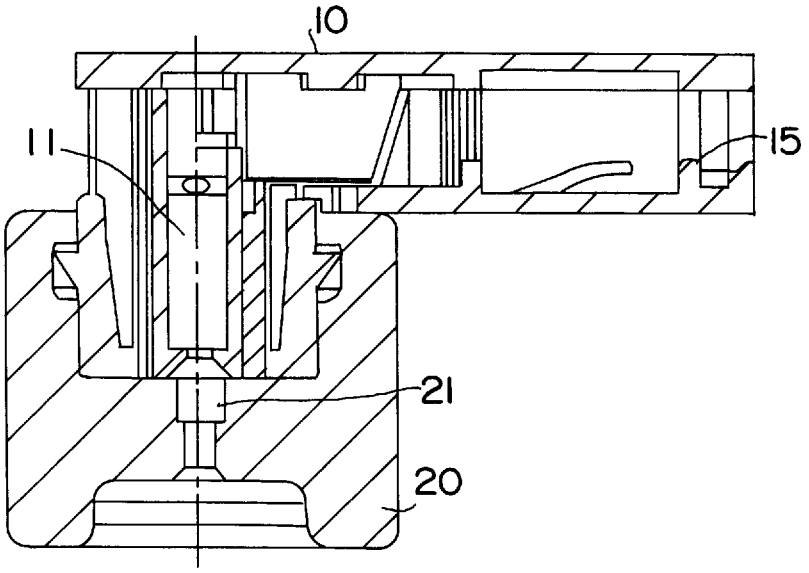
FIG. 4 is a cross-sectional view of a mated plug part and an initiator socket part of a connector according to the present invention, taken along line 4—4 in FIG. 2.
Figure 5:
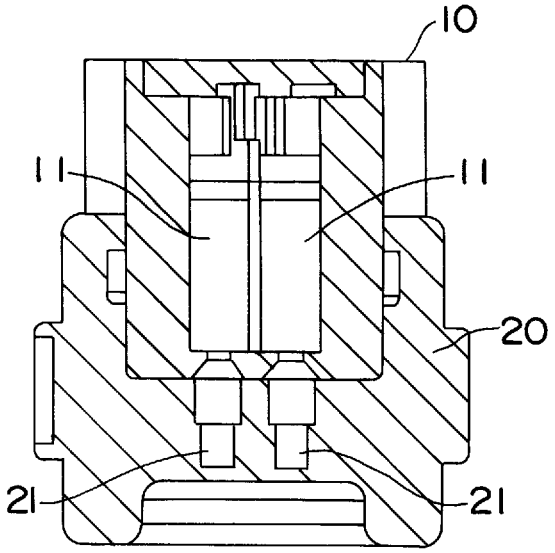
FIG. 5 is a cross-sectional view of a mated plug part and an initiator socket part of a connector according to the present invention, taken along line 5—5 in FIG. 2.
Figure 6:
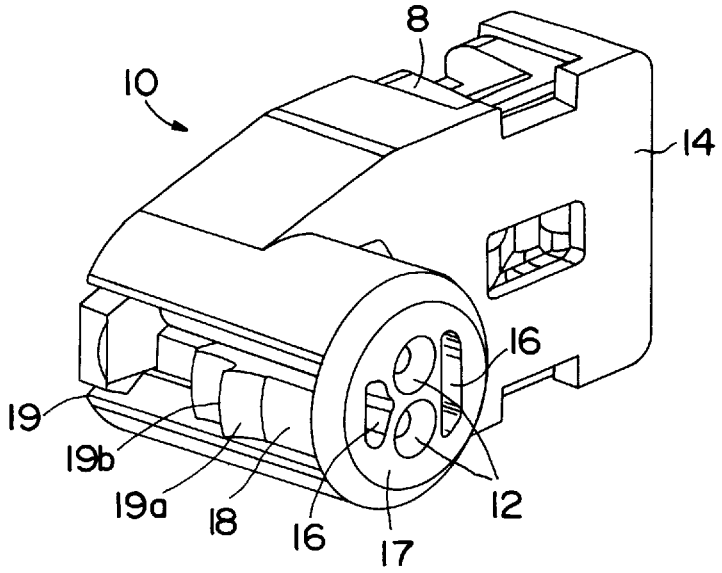
FIG. 6 is a perspective view of a plug part of a connector according to the present invention.
Figure 7:
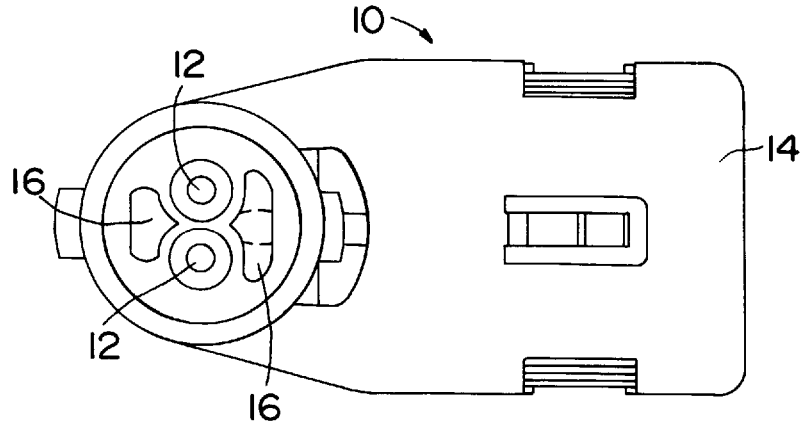
FIG. 7 is a bottom view of a plug part of a connector according to the present invention.
Figure 8:
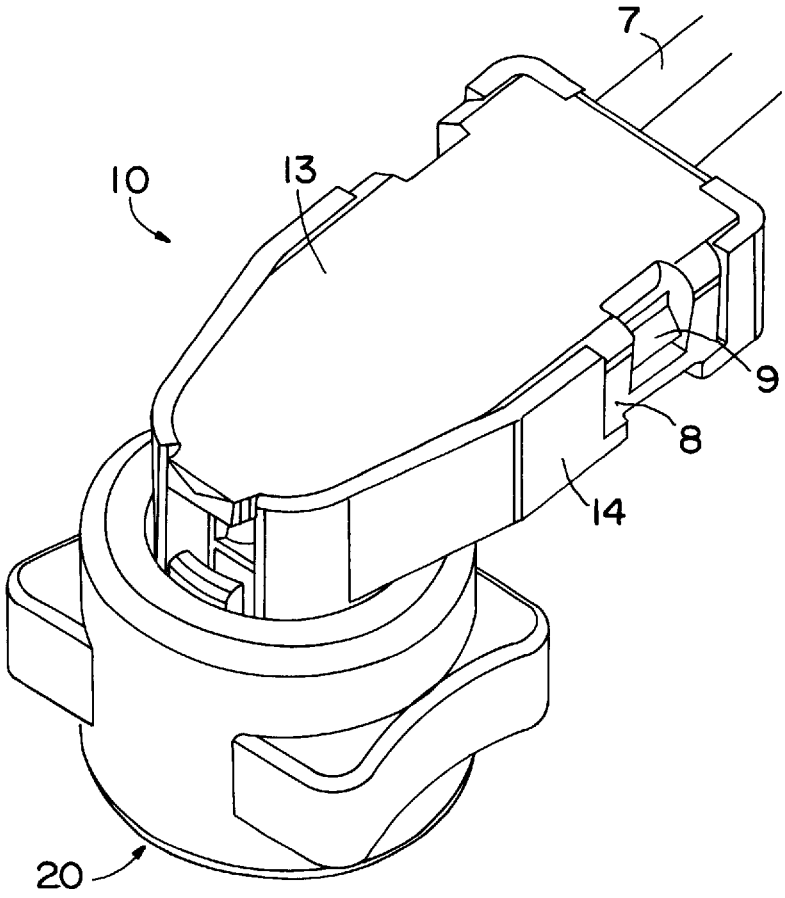
FIG. 8 is a perspective view of a mated plug part and an initiator socket part of a connector according to the present invention.
Figure 9:
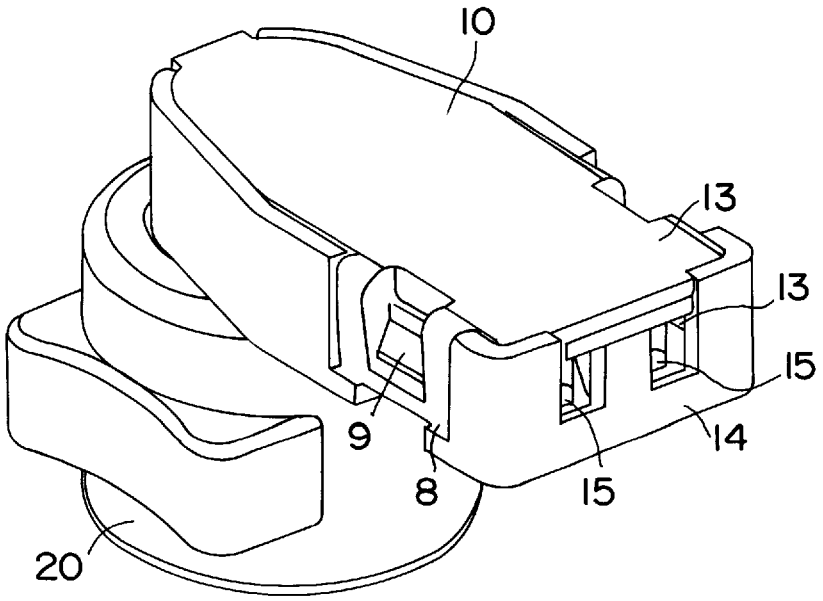
FIG. 9 is another perspective view of a mated plug part and an initiator socket part of a connector according to the present invention.

The electrical connector assembly of the present invention is best illustrated by FIGS. 1–10. FIG. 1 is a cross-sectional view of an unmated plug part 10 and an initiator socket part 20 located on an airbag detonation initiator 5. Plug part 10 is adapted to mate with socket part 20 along mating axis 23 within mating aperture 22 of socket part 20. FIG. 2 is a top view of a mated plug part 10 and an initiator socket part 20, while FIG. 3 is a cross-sectional view taken along line 3—3 in FIG. 2. FIGS. 8 and 9 are different perspective views of a mated plug part 10 and an initiator socket part 20.

Mating aperture 22 of socket part 20 includes a side wall portion 24 and a bottom wall portion 25. Side wall portion 24 has a locking slot 26. Locking slot 26 includes a shoulder portion 28 that extends substantially perpendicular to mating axis 23. Bottom wall portion 25 has at least one pin 21 contact (FIGS. 4 and 5) and at least one tab member 27. Each pin contact 21 and each tab member 27 extends from the bottom wall portion 25 substantially parallel to mating axis 23. Each tab member 27 is separated from side wall portion 24 of mating aperture 22.

Plug part 10 includes socket contacts 11 (FIG. 5) disposed in socket contact apertures 12. Socket contacts 11 are electrically connected to the conductors of wire 7 (FIG. 8). Each socket contact 11 has a first end for receiving a corresponding pin contact 21 and a second end for receiving a conductor of wire 7. Plug part 10 includes a bottom surface 17 having a socket contact aperture 12 (FIG. 6) corresponding to each pin contact 21 extending from bottom wall portion 25 of mating aperture 22, and a tab aperture 16 corresponding to each tab member 27 extending from bottom wall member 25 of mating aperture 22. Apertures 16 and tabs 27 mate together, providing both correct orientation of plug part 10 and socket part 20 when mated and structural integrity against a torsional force applied to plug part 10. FIG. 6 is a perspective view and FIG. 7 is a bottom view of a plug part 10 showing that apertures 16 can each have different cross-sectional shapes to provide connector keying.

Plug part 10 also includes a resilient locking device having at least one arm 18. Each arm 18 extends from bottom surface 17 of plug member 10 and is adapted for engaging locking slot 26 of side wall portion 24 of mating aperture 22. Each arm 18 includes a detent member 19 that has a divergent portion 19*a* and an abutment portion 19*b*. Abutment portion 19*b* extends substantially perpendicular to mating axis 23 and abuts shoulder portion 28 of locking slot 26, preventing separation of plug part 10 from socket part 20 by spreading arms 18 when a force 30 is applied.

Figure 10:
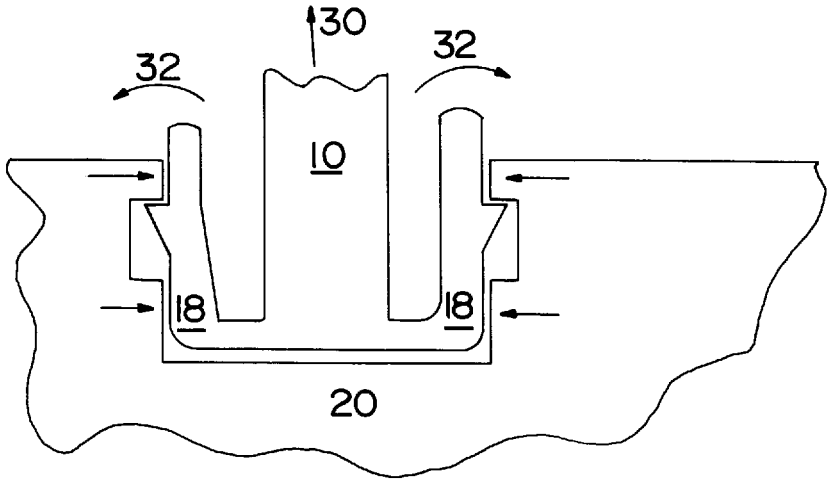
FIG. 10 is a detail view of the operation of the resilient locking arms on a plug part connector when the plug part is mated with an initiator socket part connector according to the present invention.
Figure 11:
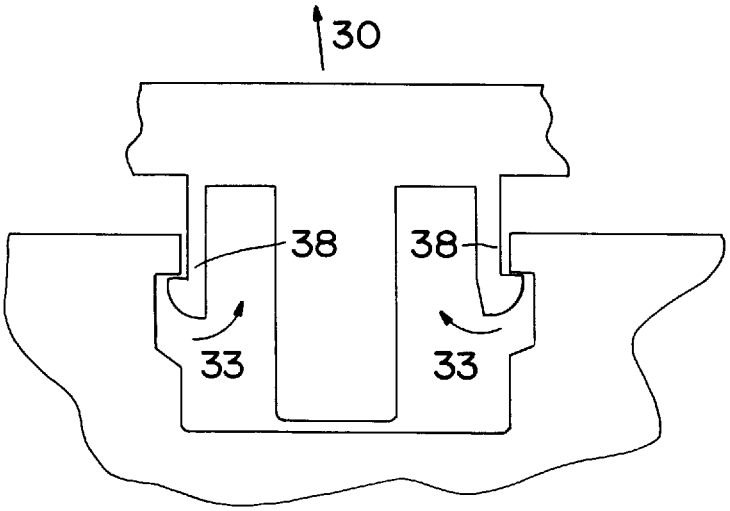
FIG. 11 PRIOR ART
FIG. 11 is a detail view of the operation of prior art locking arms.

FIG. 10 shows that, upon application of a force 30 to effect separation of the plug member from the socket member, arms 18 operate to spread apart in the direction of arrows 32 from locking plug part 10 when plug part 10 is in socket part 20, and to prevent separation of plug part 10 from socket part 20. FIG. 11 shows that, in the prior art, arms 38 respond to an application of a force 30 by moving radially together in the direction of arrows 33, allowing the plug part to be separated from the socket part.

Plug part 10 includes a cover 13 and a socket housing 14. Laterally located locking lugs 8 on cover 13 engage locking lug receiving members 9 on socket housing 14 (FIGS. 8 and 9) when cover 13 and socket housing 14 are mated. Socket housing 14 and cover 13 include nipples 15 (FIG. 4) that firmly hold wire 7 when cover 13 and socket housing 14 mate together and operates as a stress relief device for wire 7.

What is claimed is:

1. An electrical connector assembly for an airbag ignitor comprising:

(a) a socket member having a mating aperture, the mating aperture having a mating axis, a side wall portion and a bottom wall portion, the side wall portion having a locking slot, the bottom wall portion having at least one pin contact and at least one tab member offset from said mating axis, each pin contact and each tab member extending from the bottom wall portion substantially parallel to the mating axis; and (b) a right angled plug member adapted for mating with the socket member by insertion in the mating aperture along the mating axis, the plug member comprising a plug body and a plug nose, said plug nose including:

(i) a bottom surface having at least one socket contact aperture receiving a socket contact corresponding to each pin contact extending from the bottom wall portion of the mating aperture and a tab aperture corresponding to each tab member extending from the bottom wall portion of the mating aperture, and (ii) a resilient locking device adapted for engaging in the locking slot of the side wall portion of the socket member, the resilient locking device including at least two arms protruding from the bottom surface of said plug nose towards said plug body which, upon application of a force to effect separation of the plug member from the socket member, spread apart for locking the plug member in the socket member and for preventing separation of the plug member from the socket member, whereby said two arms are located on a longitudinal axis of said plug body, one of said two arms being located below said plus body.

2. The electrical connector assembly according to claim 1, wherein there are at least two tab members separated from the side wall portion of the mating aperture, and are located in a line parallel to the plug body longitudinal axis.

3. The electrical connector assembly according to claim 1, wherein said socket contact disposed within each socket contact aperture has a first end and a second end, the first end of each socket contact receiving the corresponding pin contact and the second end of each socket contact receiving a wire, said second end being perpendicular to said first end.

4. The electrical connector assembly according to claim 3, wherein the plug member comprises a cover having laterally located locking lugs, and said socket housing has locking lug receiving members engaging the locking lugs of the cover when the cover and socket housing are mated.

5. The electrical connector assembly according to claim 4, wherein the socket housing includes a nipple extending toward the cover when the socket housing and the cover are mated, the wire being clasped between the nipple and the cover.

6. The electrical connector assembly according to claim 1, wherein said bottom surface of said plug member has at least two tab apertures with different cross-sectional shapes to provide connector keying.

7. The electrical connector assembly according to claim 1, wherein said at least one pin contact is located between tab members in a line perpendicular to the plug body.

8. An electrical connector assembly for an airbag ignitor, comprising a socket member, a right-angled plug member for mating with the socket member along a mating axis, a bottom surface having at least one socket contact aperture receiving a socket contact, and a resilient locking device adapted for engaging in a locking slot of a side wall portion of the socket member, wherein the locking slot comprises a shoulder portion extending substantially perpendicular to the mating axis, the locking device including at least two arms each including a detent member having a divergent portion and an abutment portion, the abutment portion extending substantially perpendicular to the mating axis and abutting the shoulder of the locking slot so as to prevent separation of the plug member from the socket member upon spreading of the arms when force is applied.

* * * * *